US005949228A

United States Patent [19]

Shoaei et al.

[11] Patent Number: 5,949,228

[45] Date of Patent: Sep. 7, 1999

[54] FEEDBACK CIRCUIT TO COMPENSATE FOR PROCESS AND POWER SUPPLY VARIATIONS

[75] Inventors: Omid Shoaei, Allentown; Robert H. Leonowich, Temple, both of Pa.

[73] Assignee: Lucent Technologies, Inc., Murray Hill, N.J.

[21] Appl. No.: 09/096,685

[22] Filed: Jun. 12, 1998

[51] Int. Cl.[6] ..... G05F 1/56

[52] U.S. Cl. ..... 323/315; 327/541

[58] Field of Search ..... 323/312, 315, 323/907; 330/257, 288; 327/538, 535, 541

[56] References Cited

U.S. PATENT DOCUMENTS 4,057,743 11/1977 Limberg ..... 327/541
5,282,094 1/1994 Ngo ..... 360/46
5,351,012 9/1994 Toumazou ..... 330/264
5,594,382 1/1997 Kato et al. ..... 327/541
5,694,033 12/1997 Wei et al. ..... 323/315

*Primary Examiner*—Matthew Nguyen
*Attorney, Agent, or Firm*—Synnestvedt & Lechner LLP

[57] ABSTRACT

In according with the principles of the present invention, a feedback circuit to compensate for process, temperature, and power supply variations in a typical integrated chip is provided. The feedback circuit increases the accuracy and functionality of an integrated chip by generating an output feedback current that is compensated for process, temperature and power supply variations. The feedback circuit comprises a top current mirror circuit, a bottom current mirror circuit, and a sensory circuit connected to the top current mirror circuit. The sensory circuit continuously senses the variations in the process, temperature and power supply and provides the feedback to top current mirror circuit. The top current mirror adjusts its parameters accordingly and therefore an output feedback current is generated which has necessary compensations for the process, temperature and power supply variations.

29 Claims, 2 Drawing Sheets

FEEDBACK CIRCUIT TO COMPENSATE FOR PROCESS AND POWER SUPPLY VARIATIONS

FIELD OF THE INVENTION

This invention relates generally to the manufacturing of integrated chips and the use of the integrated chips in other technologies. In particular, the invention relates to the compensation of process, temperature, and power supply variations in connection with the integrated chips.

BACKGROUND OF THE INVENTION

The use of pre-manufactured, standard integrated circuit chips is common in the manufacture and the development of various hardware systems. These integrated chips act as building blocks in the design and manufacture of complicated circuit designs and other hardware systems. For example, the manufacture of a personal computer utilizes dozens of pre-manufactured integrated chips.

Even though these integrated chips are manufactured according to pre-defined specifications, the accuracy and functionality of these chips is greatly affected by external and collateral factors. These external factors include variations in the manufacturing processes, changes in the environment temperature, and changes in the power supply.

The actual performance parameters of a chip may vary from nominal specifications due to uncontrollable variations in the manufacturing processes. For example, a temperature variation in the manufacturing plant during the manufacturing process can change the process profile and therefore change the outcome manufacturing values of an integrated chip. Similarly, a change in the density of diffusion also can change the process profile and therefore change the performance parameters. These performance parameters include the speed of the integrated circuit chips.

After the integrated circuit chip has been manufactured, changes in the ambient or environment temperatures also affect the functionality and utility of an integrated chip. Each standard integrated circuit chip is manufactured to operate nominally at a standard room temperature and should accommodate some temperature variation. However, in actual practice, room temperatures vary drastically from one geographic location to another due to thermodynamic elements. Accordingly, the functionality and the accuracy of an integrated circuit chip also varies depending on the ambient temperature.

The functionality of an integrated chip also is affected by variations in the power supply. Variations in the power supply voltages typically result from fluctuations in the commercial supply of power. The power supply sources also utilize various voltage regulators. The power supply variations also may result from the differences in the manufacturing processes of the different voltage regulator vendors.

Thus, even though an integrated chip may have been manufactured according to pre-defined specifications, the variations in the manufacturing process, the ambient temperatures, and the power supply may cause an integrated chip to fluctuate from its intended operation parameters. For example, two transistors manufactured according to an identical specification may have very different speed characteristics. In different lots, there will be fast, slow and nominal transistors, with some noticeable variation.

These process, temperature and power supply variations are undesirable especially for applications where extreme precision is demanded and for which even the slightest deviation from original specification can result in unacceptable circuit performances. Thus, there exists a need for a system to compensate for these commonly known process, temperature and power supply variations, and therefore increase the utility and accuracy of integrated circuit chip.

SUMMARY OF THE INVENTION

An inventive feedback circuit is developed that senses the variations in circuit performance caused by collateral factors such as process variations, and the variations in the temperature and power supply, and generates an output feedback current. The output feedback current follows the process, and variations in the power supply, and provides the necessary compensation for these variations.

In the preferred embodiment, the inventive feedback circuit comprises a first current mirror circuit, a second current mirror circuit, and a sensory circuit connected to the first current mirror circuit. The feedback circuit also is connected to a power supply voltage source.

The feedback circuit receives a fixed output current generated by a bandgap current source located in the integrated circuit chip. Accordingly, the feedback circuit generates an output feedback current which is a function of the input current as well as the variations in the process and the power supply. Under the extreme condition where the chip speed is maximized as a result of manufacturing process variations and the power supply voltage is at maximum, the output feedback current is equal to said input current. For the other extreme condition where the chip speed is minimized as a result of manufacturing process variations and the power supply is at its minimum, the output feedback current is equal to zero.

BRIEF DESCRIPTION OF THE DRAWINGS

The invention is described in more detail hereinafter with reference to the accompanying drawings wherein like reference characters refer to the same parts throughout the several views and in which.

DETAILED DESCRIPTION OF THE PREFERRED EMBODIMENT

Figure 1:
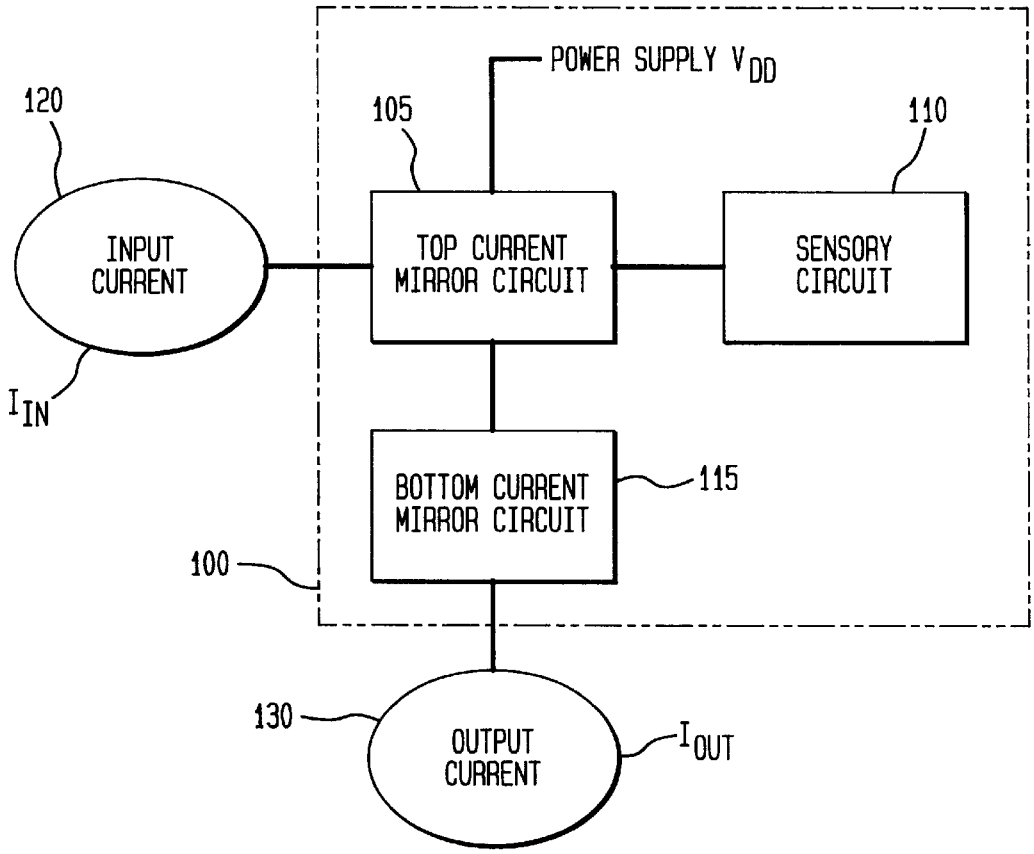
FIG. 1 is a block diagram of a feedback circuit in accordance with a preferred embodiment of the present invention.

FIG. 1 illustrates the major components of the present invention in the form of a block diagram.

The inventive feedback circuit 100 comprises a top current mirror circuit 105, a bottom current mirror circuit 115, and a sensory circuit 110 which is connected directly to the top current mirror circuit 105. The feedback circuit 100 also is connected to a power supply voltage source $V_{DD}$.

The feedback circuit 100 accepts an input current $I_{IN}$, which is a fixed supply current usually received from a band-gap circuit located in a typical integrated chip. The feedback generates an output feedback current $I_{OUT}$. $I_{OUT}$ follows the changes in the process and power supply, and provides the necessary compensation for the process, and power supply variations.

Figure 3:
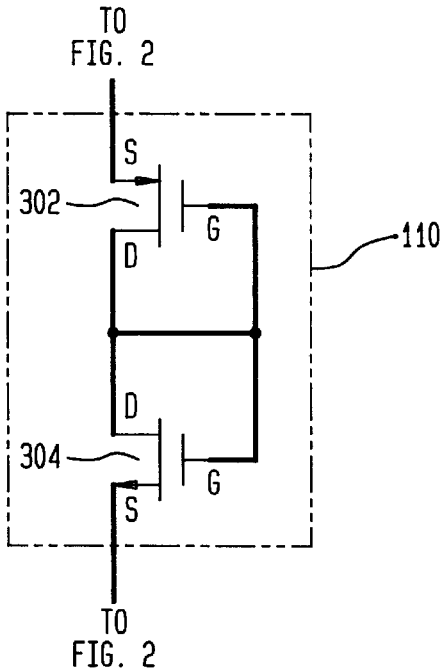
FIG. 3 is circuit diagram of a preferred embodiment of the sensory circuit used in FIG. 2.
Figure 2:
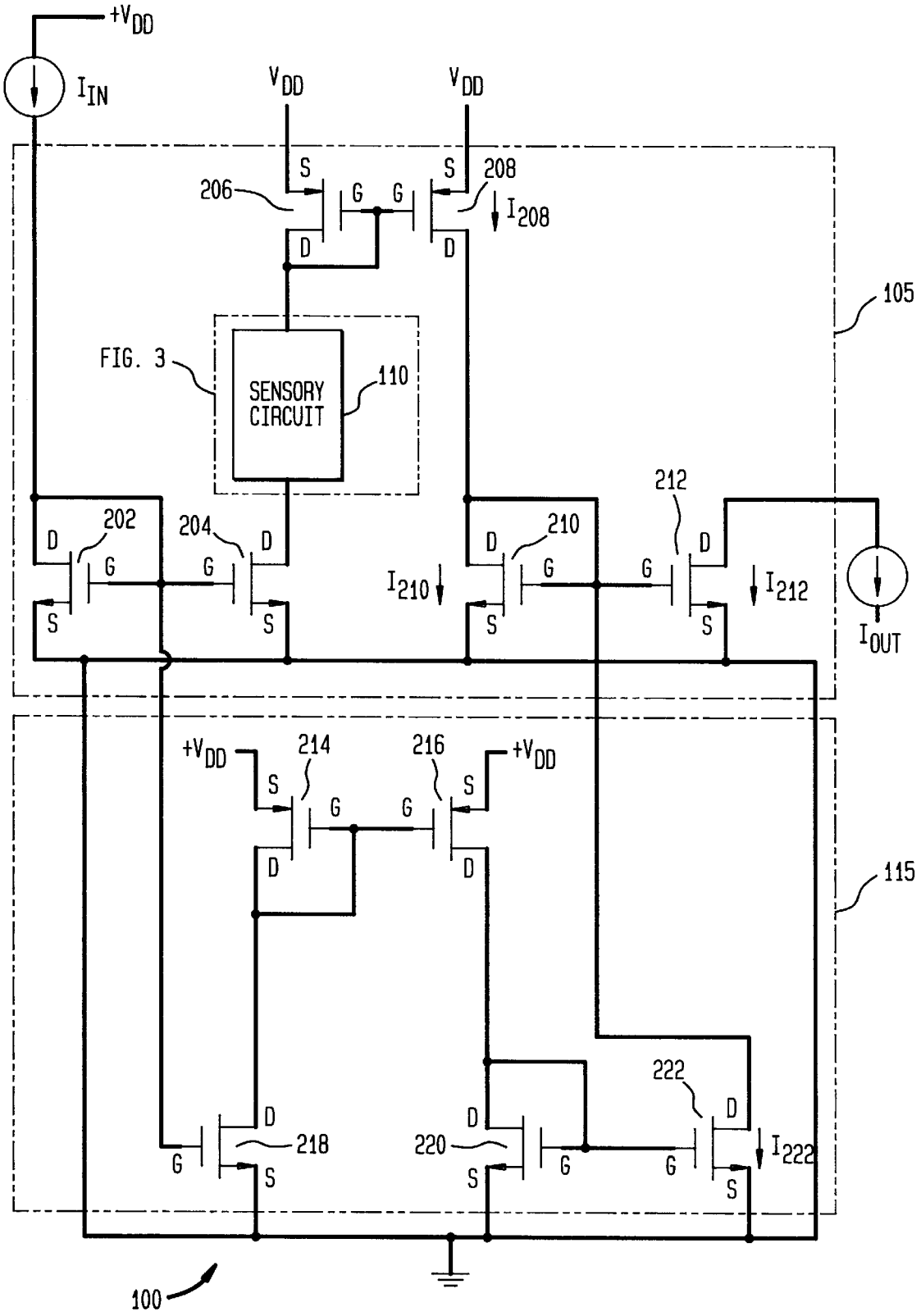
FIG. 2 is a circuit diagram of a feedback circuit in accordance with a preferred embodiment of the present invention.

FIG. 2 is a circuit diagram illustrating the details of the feedback circuit 100 in accordance with a preferred embodiment of the present invention. The top current mirror circuit 105 comprises four N-channel transistors 202, 204, 210, 212, and two P-channel transistors 206, 208. The top current mirror circuit 105 also comprises a sensory circuit 110. The preferred embodiment of sensory circuit 110 is shown in FIG. 3.

In top current mirror circuit 105, the drain and gate terminals of N-channel transistor 202 are connected to the input current $I_{IN}$ source. The gate terminal of N-channel transistor 202 is connected to the gate terminal of another N-channel transistor 204. The source terminal of the N-channel transistor 202 is connected to the ground of the power supply voltage source $V_{DD}$. The drain terminal of the N-channel transistor 204 is connected to the sensory circuit 110. The source terminal of the N-channel transistor 204 is connected to the ground of the power supply $V_{DD}$.

The drain terminal of the P-channel transistor 206 is connected to the sensory circuit 110 as well as to the gate terminal of another P-channel transistor 208. The source of the P-channel transistor 206 is connected to the positive terminal of the power supply voltage source $V_{DD}$. The gate terminal of the P-channel transistor device 206 is connected to the gate terminal of the P-channel transistor 208. The source terminal of the P-channel transistor 208 is connected to the positive end of the power supply voltage source $V_{DD}$. The drain terminal of the P-channel transistor 208 is connected to the drain and gate terminals of N-channel transistor 210.

The source terminal of the N-channel transistor 210 is connected to the ground of the power supply voltage source $V_{DD}$ and the gate terminal of the N-channel transistor 210 is connected to the gate terminal of the N-channel transistor device 212.

The source terminal of the N-channel transistor 212 is connected to the ground of positive supply voltage source $V_{DD}$. The gate terminal of the N-channel transistor is connected to the gate and drain terminals of the N-channel transistor 210. The drain terminal of the N-channel transistor is connected to the output current source $I_{OUT}$.

In top current mirror circuit 105, the source terminals of N-channel transistor devices 202, 204, 210, 212 are connected together as well as to the ground of the power supply voltage source $V_{DD}$.

The bottom current mirror circuit 115 comprises two P-channel transistors 214, 216 and three N-channel transistors 218, 220, and 222.

The top current mirror circuit 105 and bottom current mirror circuit 115 are connected such that the drain and gate terminals of the N-channel transistor 202 located in the top current mirror circuit 105 are connected to the gate terminal of the N-channel transistor 218 located in the bottom current mirror circuit 115. The drain and gate terminals of N-channel transistor 210 located in the top current mirror circuit 105 are connected to the drain terminal of the N-channel transistor 222 located in the bottom current mirror circuit 115.

In bottom current mirror circuit 115, the source terminal of the P-channel transistor 214 is connected to the positive end of the power supply voltage source $V_{DD}$. The gate terminal of the P-channel transistor 214 is connected to the gate terminal of the P-channel transistor 216. The gate and drain terminals of the P-channel transistor 214 are also interconnected. The drain terminal of the P-channel transistor 214 also is connected to the drain terminal of the N-channel transistor 218.

The gate terminal of the N-channel transistor 218 is connected to the drain and gate terminals of the N-channel transistor 202. The source terminal of the N-channel transistor 218 is connected to the ground of the power supply voltage source $V_{DD}$. The source terminal of the P-channel transistor 216 is connected to the positive end of power supply voltage source $V_{DD}$ and the drain terminal of the P-channel transistor 216 is connected to the drain terminal of N-channel transistor 220.

The source terminal of the N-channel transistor 220 is connected to the ground of the power supply voltage source $V_{DD}$. The gate and drain terminals of the N-channel transistor 220 are connected to the gate terminal of another N-channel transistor 222. The source terminal of the N-channel transistor 222 is connected to the ground terminal of the ground of the power supply voltage source $V_{DD}$.

The source terminals of the N-channel transistor 218, 220, and 222 are interconnected to each other as well as to the ground of the power supply voltage source $V_{DD}$. The drain terminal of the N-channel transistor 222 is connected to the drain and gate terminals of the N-channel transistor 210 in the top current mirror circuit 105.

The feedback circuit 100 is designed such that an output feedback current represented by $I_{OUT}$ is generated following the process and power supply conditions.

FIG. 3 illustrates a preferred embodiment of the sensory circuit 110 of FIG. 2. The sensory circuit 110 senses the changes or variations in the process, temperature and power supply, and communicates these variations to the top current mirror circuit 105.

The sensory circuit 110 in FIG. 3 comprises a P-channel transistor 302 and a N-channel transistor 304. The gate terminals of transistors 302 and 304 are inter-connected. The drain terminals of both transistors 302 and 304 are also interconnected. The gate and drain terminals of P-channel transistor 302 and N-channel transistor 304 are interconnected as well.

The source terminal of the N-channel transistor 304 is connected to the drain terminal of the N-channel transistor 204. The source terminal of the P-channel transistor 302 is connected to the drain terminal of the P-channel transistor 206.

The P-channel transistor 302 and the N-channel transistor 304 act as sensory diodes sensing the effect of the process and temperature variations on their gate to source voltages. The MOS threshold voltages of the P-channel transistor 302 and the MOS threshold voltage of the N-channel transistor 304 are respectively termed $V_{t302\ and\ Vt304}$. $V_{t302}$ and $V_{t304}$ are sensitive to the process and temperature variations, and thereby change the voltage drop across the sensory circuit 110 which is a sum of a P-channel gate-to-source voltage and an N-channel gate-to-source voltage. This in turn alters the drain-to-source voltage of the N-channel transistor 204 and the drain-to-source voltage of the P-channel transistor 206. The drain-to-source voltages of the N-channel transistor 204 and the P-channel transistor 206 are respectively termed $V_{DS204}$ and $V_{DS206}$.

As $V_{DS204}$ and $V_{DS206}$ change, the current in the top current mirror 105 also changes. Therefore, the current in the top current mirror 105 also is responsive to the process and power supply variation.

Specifically, the top current mirror circuit 105 receives input current $I_{IN}$ which is directly fed into top current mirror 105 via the drain terminal of N-channel transistor 202. Therefore, the current in the N-channel transistor 202 ($I_{202}$) is equal to $I_{IN}$. The input current $I_{IN}$ is also fed to the bottom current mirror 115 via the gate terminal of the N-channel transistor 218. Therefore, the current in the N-channel transistor 218 is controlled as a function of $I_{IN}$. The gate of the N-channel transistor 202 is connected to gate terminal of the N-channel transistor 218. This creates a simple current mirror, so $I_{IN}$ is mirrored into N-channel transistor 218.

The output current generated in the bottom current mirror $I_{222}$ is subtracted from the current generated in the top current mirror $I_{208}$ so the resulting current $I_{210}$ is equal to the result of the subtraction, $I_{210}=I_{208}-I_{222}$. The resulting current $I_{210}$ is then mirrored into the current generated from the N-channel transistor ($I_{212}$) to generate the output feedback current $I_{OUT}$. The resulting output feedback current $I_{OUT}$ is equal to two times the value of $I_{210}$.

Since the output feedback current $I_{OUT}$ is a function of the current of the top current mirror circuit 105 ($I_{210}$), it also is a function of the process and power supply variations.

Under normal conditions, $I_{OUT}$ follows the process and power supply conditions and is defined in Equation 1 as:.

$$I_{OUT} = I_{IN}\left[1 - \frac{4\lambda(V_{T302} + V_{T304})}{1 + \lambda(V_{DD} - |V_{GS214}| - V_{EFF218,204})}\right]$$

wherein $I_{IN}$,=input current;

$\lambda$=output impedance constant (pre-defined for each technology in units of $V^{-1}$);

$V_{t302}$=MOS threshold voltage of P-channel transistor 302;

$V_{t304}$=MOS threshold voltage of N-channel transistor 304;

$V_{DD}$=power supply voltage source;

$V_{GS214}$=gate-to-source voltage of P-channel transistor 214;

$V_{EFF218,204}=(V_{GS218,204}-V_{t218,204})$ wherein $V_{GS218,204}$ is the gate-to-source voltage of either P-channel transistor 218 or the N-channel transistor 204; and $V_{t128,204}$ is the MOS threshold voltage of either P-channel transistor 218 or the N-channel transistor 204.

For a more detailed description on the above parameters, see Analog Integrated Circuit Design by David John and Ken Martin, John Wiley Publication, 1997, which is incorporated herein by reference.

As can be seen from the above equation, the feedback current $I_{OUT}$ has strong dependency on the process and power supply changes as reflected in the ($V_{t302}+V_{t304}$) function. The ($V_{t302}+V_{t304}$) function increases when the process is slower and the resulting threshold voltage $V_t$ is high. The ($V_{t302}+V_{t304}$) function decreases when the process is faster and the resulting threshold voltage $V_t$ is low.

When ($V_{t302}+V_{t304}$) decreases and the second term in Equation 1 becomes negligible, $I_{OUT}$ approaches $I_{IN}$. When ($V_{t302}+V_{t304}$) increases, the output feedback current $I_{OUT}$ decreases. When ($V_{t302}+V_{t304}$) increases and the second term in Equation 1 approaches 1, the output feedback current $I_{OUT}$ diminishes completely.

$I_{OUT}$ is also strongly dependent on the power supply voltage variation ($V_{DD}$). As the power supply ($V_{DD}$) decreases, the feedback current $I_{OUT}$ also decreases, and as the power supply ($V_{DD}$) increases, the feedback current $I_{OUT}$ also increases.

$I_{OUT}$ is also dependent on the temperature variations. As the temperature increases, the MOS threshold voltage ($V_t$) decreases but the MOS effective voltage ($V_{EFF}$) increases with the rise in temperature. Similarly, when the temperature decreases, the MOS threshold voltage increases, but MOS effective voltage ($V_{EFF}$) decreases. Thus, the MOS threshold voltage ($V_t$) and the MOS effective voltages ($V_{EFF}$) react in opposite directions with the temperature variations. As a result, the feedback current $I_{OUT}$ is kept almost constant over a very wide range of temperature variations.

Under the extreme conditions where the integrated circuit chip speed is fast as a result of the manufacturing process variations (MOS threshold voltage $V_t$ is low), and the power supply is at maximum (usually $1.1V_{DD}$), the output feedback current ($I_{OUT}$) is equal to the input current ($I_{IN}$). At the other extreme, where the integrated circuit chip speed is slow as a result of the manufacturing process variations (MOS threshold voltage $V_t$ is high), and the power supply is at its minimum (usually 0.9 $V_{DD}$), the feedback current ($I_{OUT}$) is zero.

In summary, a feedback circuit 100 is disclosed such that an output feedback current represented by $I_{OUT}$ is generated following the process and power supply conditions.

This feedback current $I_{OUT}$ usually is coupled with a typically fixed current in an integrated chip such that the feedback current adjusts the typical output current accordingly to compensate for process and power supply variations. The resulting typical output current is more accurate according to the specification. Overall, the inventive feedback circuit increases the utility and accuracy of the integrated chips. A typical use of such feedback circuit 100 will be in current line-drivers and continuous-time filters.

Having thus described a few particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

We claim:

1. A feedback circuit for generating an output feedback current to compensate for variations in an integrated circuit caused by collateral factors, said feedback circuit comprising:

a first current mirror circuit coupled to receive an input current and coupled to generate said output feedback current to said integrated circuit;

a sensory circuit coupled to said first current mirror circuit for sensing variations in said integrated circuit caused by said collateral factors and adjusting a voltage drop across itself in response to said variations;

a second current mirror circuit coupled to said first current mirror circuit, said second current mirror circuit receiving a mirror of said input current and generating a compensation current that is fed back to said first current mirror circuit; and a power supply voltage source connected to said first current mirror circuit and said second current mirror circuit, said power supply supplying power to said feedback circuit.

2. The feedback circuit of claim 1 wherein said variations comprise at least one of process, temperature, and power supply variations.

3. The feedback circuit of claim 1, wherein said first current mirror circuit adjusts its parameters in response to said voltage drop across said sensory circuit.

4. The feedback circuit of claim 2, wherein said sensory circuit senses the variations in the process, temperature, and power supply, and adjusts the current in said first current mirror circuit.

5. The feedback circuit of claim 2 wherein said sensory circuit comprises a diode-connected P-channel transistor device and a diode connected N-channel transistor device connected in series.

6. The feedback circuit of claim 5 wherein said sensory circuit adjusts gate to source voltages of said diode-connected P-channel and N-channel transistor devices in response to said variations.

7. The feedback circuit of claim 2 wherein said output current in said first mirror circuit is responsive to said process and power supply variations.

8. The feedback circuit of claim 2 wherein said first current mirror circuit receives information on said variations in the process, temperature, and power supply, and wherein said first current mirror circuit adjusts its parameters according to said variations.

9. The feedback circuit of claim 1 wherein said input current is a fixed current generated by a band-gap current source.

10. The feedback circuit of claim 2 wherein said output feedback current is a function of said input current and said variations.

11. The feedback circuit of claim 2 wherein said output feedback current is equal to said input current when said collateral factors are such as to cause said integrated circuit to operate at its maximum speed and said power supply is at its maximum positive level.

12. The feedback circuit of claim 2 wherein said output feedback current is equal to zero when said collateral factors are such as to cause said integrated circuit to operate at its minimum speed and said power supply is at its maximum negative level.

13. The feedback circuit of claim 1 wherein said first current mirror circuit comprises a plurality of P-channel and N-channel transistors.

14. The feedback circuit of claim 13 wherein said first current mirror circuit comprises:

a first N-channel transistor and a second N-channel transistor, drain and gate terminals of the first N-channel transistor coupled to receive said input current, said gate terminal of the first N-channel transistor connected to said gate terminal of the second N-channel transistor, a source terminal of the first N-channel transistor connected to ground of said power supply voltage source, said drain terminal of the second N-channel transistor connected to said sensory circuit, a source terminal of the second N-channel transistor connected to ground of said power supply voltage source;

a first P-channel transistor and a second P-channel transistor, a drain terminal of the first P-channel transistor connected to said sensory circuit, a drain terminal of the first P-channel transistor connected to gate terminal of the second P-channel transistor, a source terminal of the first P-channel transistor connected to the positive end of said power supply voltage source, a gate terminal of the first P-channel transistor connected to gate terminal of the second P-channel transistor, and a source terminal of the second P-channel transistor connected to the positive end of the power supply voltage source; and a third N-channel transistor and a fourth N-channel transistor, a source terminal of the third N-channel transistor connected to the ground of said power supply voltage source, a gate terminal of third N-channel transistor connected to gate terminal of the fourth N-channel transistor, and a drain terminal and a gate terminal of the third N-channel transistor connected to said drain terminal of the second P-channel transistor, said gate terminal of the fourth N-channel transistor connected to said second current mirror circuit, said source terminal of the fourth N-channel transistor connected to ground of said power supply voltage source, and said drain terminal of the fourth N-channel transistor coupled to generate said output current.

15. The feedback circuit of claim 1 wherein said second current mirror circuit comprises a plurality of P-channel and N-channel transistors.

16. The feedback circuit of claim 15, wherein said second current mirror circuit comprises:

a first P-channel transistor and a second P-channel transistor, a source terminal of said first P-channel transistor connected to positive end of the power supply voltage source, a gate terminal of said first P-channel transistor connected to gate terminal of said second P-channel transistor, said gate terminal and said drain terminal of said first P-channel transistor inter-connected, a source terminal of said second P-channel transistor connected to said positive end of said power supply voltage source;

a first N-channel transistor, a second N-channel transistor, and a third N-channel transistor, source terminals of said first N-channel transistor and said second N-channel transistor and said third N-channel transistors inter-connected, a gate terminal of said first N-channel transistor connected to said first current mirror circuit, a source terminal of the N-channel transistor connected to ground of said power supply voltage source, a drain terminal of said first N-channel transistor connected to said drain terminal of said first P-channel transistor, a drain terminal of said second N-channel transistor connected to a drain terminal of the second P-channel transistor, a source terminal of said second N-channel transistor connected to ground of said power supply voltage source, said gate terminal and said drain terminal of said second N-channel transistor connected to a gate terminal of said third N-channel transistor, and a drain terminal of said third N-channel transistor connected said first current mirror circuit.

17. An integrated circuit including a feedback circuit for generating an output feedback current to compensate for variations in said integrated circuit caused by collateral factors, said integrated circuit comprising:

a first current mirror circuit coupled to receive an input current and coupled to generate said output feedback current to said integrated circuit;

a sensory circuit coupled to said first current mirror circuit for sensing variations in said integrated circuit caused by said collateral factors and adjusting a voltage drop across itself in response to said variations;

a second current mirror circuit coupled to said first current mirror circuit, said second current mirror circuit receiving a mirror of said input current and generating a compensation current that is fed back to said first current mirror circuit; and a power supply voltage source connected to said first current mirror circuit and said second current mirror circuit, said power supply supplying power to said feedback circuit.

18. The integrated circuit of claim 17 wherein said variations comprise at least one of process, temperature, and power supply variations.

19. The integrated circuit of claim 17 wherein said first current mirror circuit adjusts its parameters in response to said voltage drop across said sensory circuit.

20. The integrated circuit of claim 18, wherein said sensory circuit senses the variations in the process, temperature, and power supply, and adjusts the current in said first current mirror circuit.

21. The integrated circuit of claim 18 wherein said sensory circuit comprises a diode-connected P-channel transistor device and a diode connected N-channel transistor device connected in series.

22. The integrated circuit of claim 21 wherein said sensory circuit adjusts gate to source voltages of said diode-connected P-channel and N-channel transistor devices in response to said variations.

23. The integrated circuit of claim 17 wherein said output current in said first mirror circuit is responsive to said process and power supply variations.

24. The integrated circuit of claim 18 wherein said first current mirror circuit receives information on said variations in the process, temperature, and power supply, and wherein said first current mirror circuit adjusts its parameters according to said variations.

25. The integrated circuit of claim 17 wherein said input current is a fixed current generated by a band-gap current source.

26. The integrated circuit of claim 18 wherein said output feedback current is a function of said input current and said variations.

27. The feedback circuit of claim 18 wherein said output feedback current is equal to said input current when said collateral factors are such as to cause said integrated circuit to operate at its maximum speed and said power supply is at its maximum positive level.

28. The integrated circuit of claim 18 wherein said output feedback current is equal to zero when said collateral factors are such as to cause said integrated circuit to operate at its minimum speed and said power supply is at its maximum negative level.

29. The integrated circuit of claim 17 wherein said first current mirror circuit comprises a plurality of P-channel and N-channel transistors.

* * * * *